United States Patent [19]

Lennartson

[11] 4,149,653

[45] Apr. 17, 1979

[54] INSERT MEMBER FOR A HELICAL DISPENSING COIL

[75] Inventor: Douglas G. Lennartson, Coon Rapids, Minn.

[73] Assignee: Gross-Given Manufacturing Company, St. Paul, Minn.

[21] Appl. No.: 877,089

[22] Filed: Feb. 13, 1978

[51] Int. Cl.[2] ..... G07F 11/00

[52] U.S. Cl. ..... 221/75

[58] Field of Search ..... 221/75

[56] References Cited

U.S. PATENT DOCUMENTS

| | | | |
|---|---|---|---|
| 339,561 | 4/1886 | Locke | 198/522 |
| 3,269,595 | 8/1966 | Krakauer et al. | 221/75 |
| 3,294,281 | 12/1966 | Schlaf | 221/75 |
| 3,335,907 | 8/1967 | Holstein et al. | 221/75 |
| 3,344,953 | 10/1967 | Krakauer et al. | 221/75 |
| 3,441,174 | 4/1969 | Kenny | 221/75 |
| 3,601,281 | 8/1971 | Schlaf | 221/75 |
| 3,653,540 | 4/1972 | Offutt | 221/75 |
| 4,023,704 | 5/1977 | Pitel et al. | 221/75 |

*Primary Examiner*—Allen N. Knowles

[57] ABSTRACT

In a dispensing machine of a helical coil type having a plurality of shelves which each contain at least one elongated helical dispensing coil, an insert member is received inside the convolutions of selected coils. Each insert member comprises a plastic rail member having a bracket at one end. The bracket loosely and nonrotatably journals the insert member about the shank of the output shaft of the motor for the coil. The insert member extends forwardly through the coil to a position between the last and next to last convolutions of the coil. The insert member is free floating relative to the coil by virtue of its mounting and rides on the inner surfaces of the lowermost portions of the convolutions of the coil. Rotation of the coil imparts a rocking movement to the insert member. Thus, the insert member supports the products received in the coil above the shelf surface and further agitates these products to prevent their sticking to the insert member.

14 Claims, 5 Drawing Figures

FIG. 3
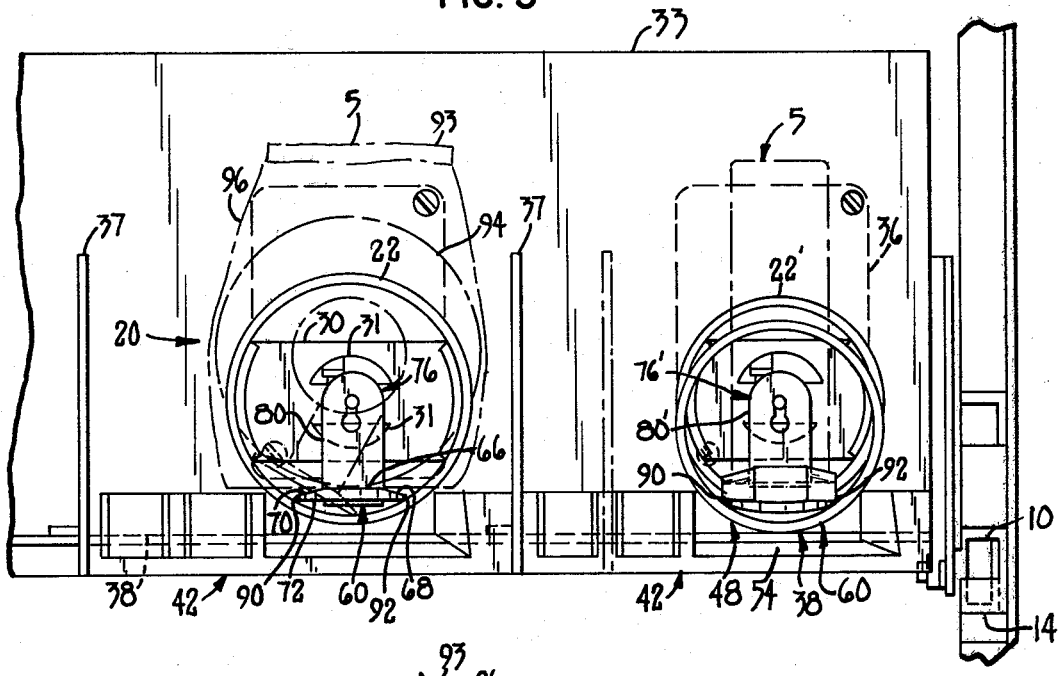
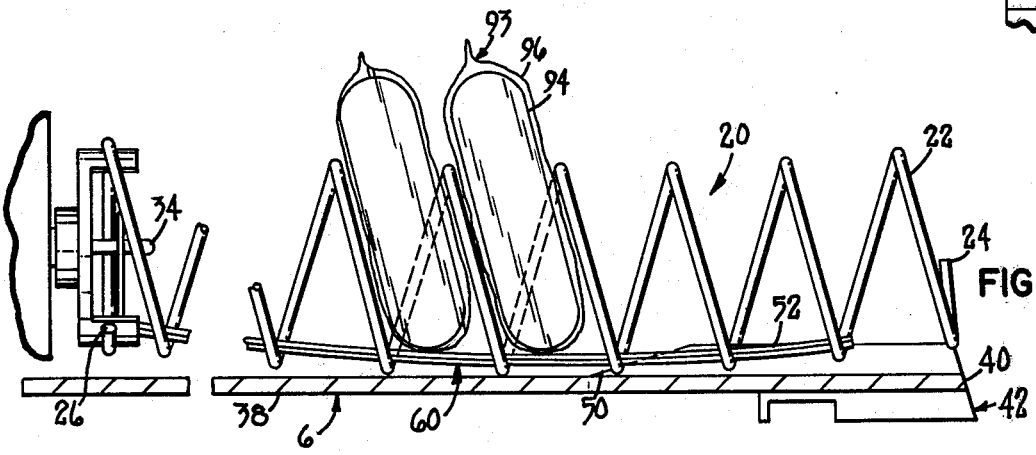
FIG. 4
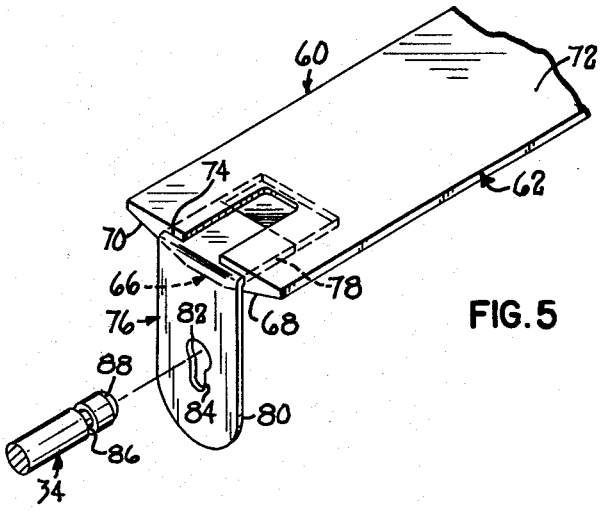
FIG. 5

INSERT MEMBER FOR A HELICAL DISPENSING COIL

BACKGROUND OF THE INVENTION

1. Field of the Invention

The present invention relates to helical coil vending machines which are also known as spiral venders. More particularly, the present invention relates to the elongated helical dispensing coils customarily used in this type of vending machine.

2. Description of the Prior Art

Automated vending machines which dispense a selected food product upon insertion by a purchaser of a required amount of money are well known. Such vending machines have various kinds of dispensing mechanisms depending upon the particular type of food product which is being vended. One well known class of such vending machines are those known in the trade as helical coil vending machines or, alternatively, as spiral venders. These machines are widely used for dispensing pre-packaged food products of the type containing pastries, potato chips, candy bars and the like.

Helical coil dispensing machines customarily include a housing which supports a plurality of vertically spaced shelves. Each of the shelves usually includes a plurality of elongated dispensing coils which run from front to back on the shelf. The rear end of each dispensing coil is operatively connected to an electric motor for selectively rotating the coil. In addition, each of the coils contains a plurality of food products which are received between the convolutions of the coil. These food products will ride along the surface of the shelf as they are moved forward in a step-by-step manner by consecutive rotations of the coil. Finally, the products are dispensed over the forward edge of the shelf where they fall down through a discharge space into a discharge bin for manual removal by the purchaser.

In the usual situation where the food products contact or slide along the shelf surface as they are received between the convolutions of the coils, certain food products are sometimes difficult to vend properly. For example, some food products, usually relatively heavy pastry products such as donuts and the like, are often wrapped in a saran wrap type of wrapping. As is commonly known, this type of wrapping tends to cling or stick to various things in part because of its composition. Thus, when food products wrapped in such a material are contained between the convolutions of the coil, they are likely to cling or stick to various portions of the shelf surface. Sometimes, such products cling to the shelf with such force that the dispensing coil becomes jammed rendering it inoperative. This requires that a serviceman clear the jammed coil before the products contained therein can be further vended. The need for such servicing, which may be quite frequent in this situation, is generally disadvantageous and costly.

Certain vending machines are known which utilize an insert member that longitudinally runs through the interior of the convolutions of the coil. These insert members define support surfaces which at least partially support the food products contained in the coil. Typical examples of such support surfaces are shown in U.S. Pat. No. 3,335,907 to Holstein et al and U.S. Pat. No. 3,344,953 to Krakauer et al. While such support surfaces are sometimes configured to support the food products above the shelf of the machine which inherently limits contact of the products with the shelf, the food products themselves will often tend to cling to various portions of the support surfaces. This is due at least partially to the fact that such support surfaces are fixedly mounted relative to the coil. In addition, the support surfaces also extend through the discharge end of the coil to terminate in front of the coil. Thus, as the food products are being vended from the last convolution at the discharge end of the coil, the vended products sometimes have a tendency to cling to or rest on the support surface even after being vended. In addition, such support surfaces sometimes only serve as a continuation of the horizontal shelf in the vending machine. In this case, they do not even partially alleviate the problem of the food products having a tendency to stick to the shelf surface.

SUMMARY OF THE PRESENT INVENTION

It is an aspect of the present invention to provide an elongated helical coil dispensing unit in a food product vending machine which incorporates an elongated insert member that substantially prevents food products from sticking to the shelf surfaces in the machine.

The present invention comprises an insert member for a vending machine having a housing. The housing contains a plurality of vertically spaced shelves each of which contain at least one elongated helical dispensing coil thereon. The coil has a plurality of convolutions for receiving the food products to be vended. In addition, the coil terminates at a discharge end that is spaced from one wall of the housing to define a discharge space into which the food products are vended. Each of the coils are operatively connected to motor means for selective rotation of the coil. The motor means includes an elongated shank which is coaxial with the axis of the coil and extends into the interior of the coil. The insert member comprises an elongated plastic rail member which is received inside the convolutions of the coil and extends along a major portion of the coil's length. The rail member has a bracket at one end which loosely and nonrotatably journals the rail about the shank of the motor means. This allows the rail member to be free-floating relative to the coil such that rotation of the coil imparts movement to the rail member to agitate the food products supported thereby. Thus, the insert member of the present invention serves to prevent the food products from sticking to the shelf surface and any other portion of the vending machine.

BRIEF DESCRIPTION OF THE DRAWINGS

The present invention will be described hereafter in the Detailed Description, when taken in conjunction with the following drawings, in which like reference numerals refer to like elements throughout.

FIG. 3 is an enlarged fragmentary view in front elevation of a vending coil unit and its associated underlying shelf, as disclosed in FIG. 1, showing the insert members of the present invention disposed inside each of the coils;

FIG. 4 is a fragmentary side elevational view of a portion of a vending coil unit, underlying support shelf, and insert member as disclosed in FIG. 3; and FIG. 5 is a partial perspective view of the bottom portion of the insert member according to the present invention showing the L-shaped mounting bracket thereof.

DETAILED DESCRIPTION

Figure 1:
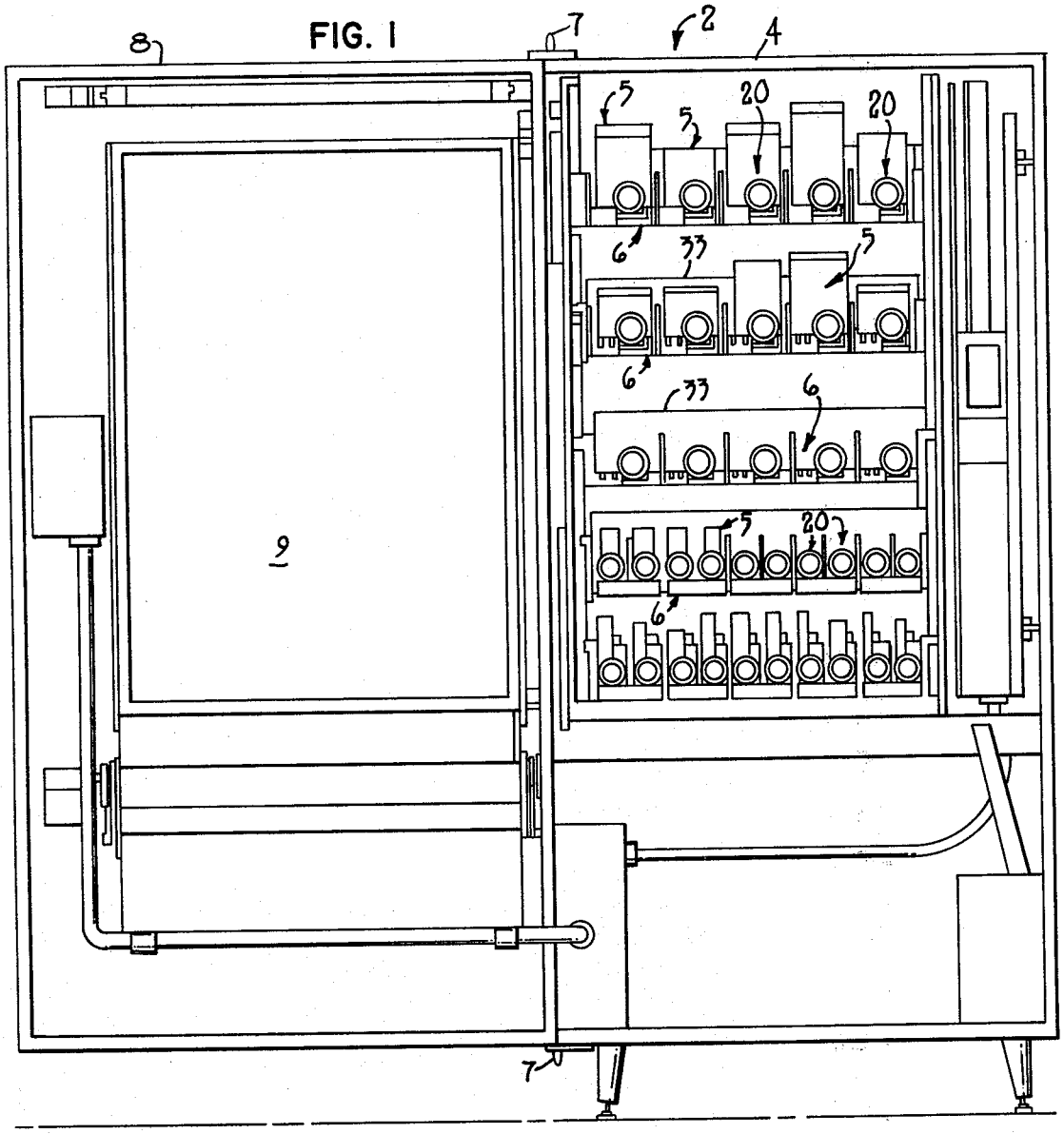
FIG. 1 is a view in front elevation of an improved vending machine according to the present invention showing a possible arrangement of a plurality of support shelves within the vending machine and a plurality of vending coil units overlying the respective support shelves.

Referring first to FIG. 1, an improved vending machine according to the present invention is generally indicated as 2. Vending machine 2 is preferably of the type disclosed in U.S. Pat. No. 4,061,245, issued on Dec. 6, 1977, to Joseph A. Lotspeich and assigned to the assignee of the present application. The above-noted patent is hereby incorporated by reference; this patent discloses various details of vending machine 2 which are not pertinent to an understanding of the present invention. Thus, vending machine 2 will be described herein only insofar as is necessary for a background to and an understanding of the present invention. Further reference may be had to the above-noted patent for other details of vending machine 2.

Vending machine 2 is provided with an outer housing 4 having a plurality of vertically spaced and horizontally disposed dispensing shelves or trays 6. Housing 4 defines a substantially enclosed rectangular cabinet which is suitable for containing and dispensing a plurality of pre-packaged food products generally indicated as 5. Vending machine 2 also has a front door member 8 which is shown in an open position in FIG. 1 to reveal the interior of housing 4. Door member 8 is pivotably mounted to housing 4 along one side of the housing by hinges 7. In addition, door member 8 is normally locked in a closed position to cover the shelves 6 contained within the internal cavity of housing 4. A window or transparent panel 9 is provided in door member 8 so that a person contemplating the purchase of a dispensable food product 5 may view the various products 5 contained on shelves 6 even when door member 8 is closed.

Figure 2:
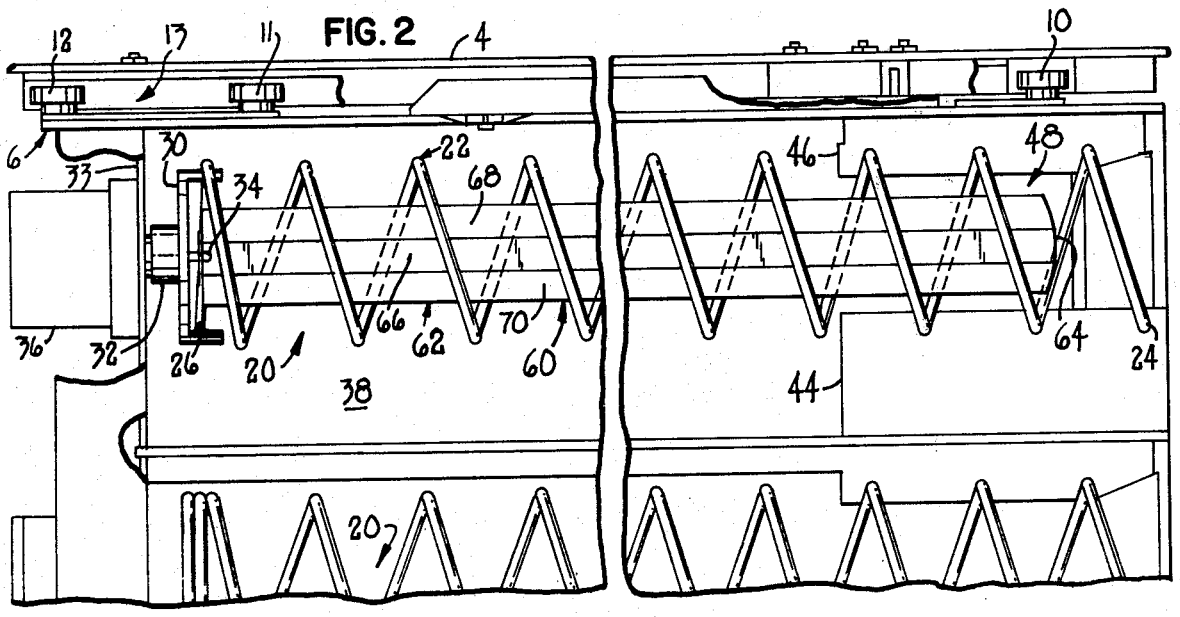
FIG. 2 is a fragmentary top plan view of a portion of one of the support shelves of the vending machine disclosed in FIG. 1, illustrating the insert member of the present invention installed in the interior of one of the coils.

Referring now to FIG. 2, each of the shelves 6 is movably mounted in housing 4 by a plurality of rollers 10–12 which are rotatably journaled on the side panels of shelf 6. Rollers 10–12 ride in opposed U-shaped channels 13 fixedly attached to the side walls of housing 4. This enables each of the shelves 6 to be rolled out of housing 4 for loading the food products 5 therein. A front stop 14 is provided at the front end of each of the channels 13 for holding or locking the shelves 6 in a normal operative position entirely disposed within the housing 4. At least some of the shelves 6 may also have additional structure allowing them to be pulled out and tilted down relative to the housing 4 to ease the task of loading them with the food products 5, as generally described in the above-referenced patent.

Each of the dispensing shelves 6 contains a plurality of transversely spaced dispensing units 20. Each dispensing unit 20 contains one elongated helical dispensing coil 22 or 22′ which extends from the front to the back of the shelf 6. Coils 22 and 22′ are identical except for being differently sized. Each coil has a plurality of convolutions and a generally circular cross-section. Each coil terminates at the front of the shelf 6 in a discharge end 24 or 24′ and at the rear of shelf 6 in a driven end 26 or 26′. The discharge ends 24 or 24′ of all the coils 22 and 22′ in machine 2 are appropriately spaced from one wall of housing 4 (e.g., door member 8) to provide a discharge space into which food products 5 are vended. The vended food products fall down into a discharge bin where they may be manually removed by the purchaser.

The driven ends 26 or 26′ and the rearmost convolutions of each coil 22 or 22′ are welded or otherwise fixedly attached to a U-shaped cross-bracket 30. Cross-bracket 30 of each coil is detachably connected to a cross-bracket holding member 32. Both cross-bracket 30 and cross-bracket holding member 32 are of the type shown in the above-referenced patent. Cross-bracket holding member 32 is operatively coupled to an elongated output shaft or shank 34 of an electric motor 36. One electric motor 36 is provided for rotating each coil 22 and 22′. Each electric motor 36 is fixedly attached as by screws to the rear wall 33 of the shelf. Cross-bracket 30 has two opposed semi-circular slots 31 (FIG. 3) for detachably receiving a plurality of retaining clips (not shown) on cross-bracket holding member 32. This detachable coupling between cross-bracket 30 and cross-bracket holding member 32 allows coils of various sizes (i.e., coils 22 and 22′) to be quickly and easily interchanged to any given dispensing unit 20.

As shown in FIGS. 1 and 3, at least two differently sized coils 22 and 22′ are preferably arranged in vending machine 2. One of these coils, i.e. coil 22, has a larger diameter than the other coil 22′. The two differently sized coils are respectively designed for dispensing different types of food products 5. For example, the coil 22 with the larger diameter is designed for dispensing larger sized products 5 such as potato chips, large pastries, large boxed food items, and the like. The coil 22′ with the smaller diameter is designed for dispensing smaller products such as elongated candy bars and the like. In addition, the coil 22 or 22′ in each dispensing unit 20 is bounded by two longitudinally extending side walls 37 which support and guide the food products as they are being vended. The side walls of shelf 6 serve as the outer side walls 37 for the outermost coils on each shelf 6. In addition, side walls 37 may be transversely adjustable on each shelf (e.g., by tabs (not shown) on the bottom of side walls 37 which releasably engage in selected ones of transversely spaced slots on the upper surface 38 of each shelf 6 or by any other appropriate adjusting means). This allows the spacing between side walls 37 to be decreased as necessary when a coil 22′ of relatively small diameter is used in the dispensing unit 20 to vend relatively small food products.

Cross brackets 30 when coupled to each of the motors 36 are positioned relative to the respective shelves 6 to support the rear ends 26 and 26′ of the coils 22 and 22′ above the upper surface 38 of the shelf 6. Upper surface 38 of shelf 6 terminates in a front edge 40. In addition, the discharge end 24 of each large diameter coil 22 is supported above shelf surface 38 by a front coil support apparatus 42. Coil support apparatus 42 comprises first and second elongated coil support members 44 and 46 which are transversely spaced from one another to define a channel 48 in which discharge end 24 of coil 22 is received. Coil 22′ has a diameter small enough to be received wholly inside channel 48. Thus, coil 22′ extends forwardly from motor 36 and is received between coil support members 44 and 46 such that coil 22′ sags downwardly into engagement with shelf surface 38 over a major portion of its length. The rear ends of the first and second coil support members 44 and 46 each slope upwardly to define a ramp 50.

Ramp 50 leads between the shelf surface 38 and an upper planar support surface 52 on each of the support members 44 and 46 which supports the discharge end 24 of each large diameter coil 22. The first and second support members are joined together at the front ends thereof by a downwardly extending ramp 54. Coil support apparatus 42 is preferably of the type shown in the U.S. patent application of Joseph A. Lotspeich, Ser. No. 839,817, filed on Oct. 6, 1977, which is also assigned to the assignee of the present invention. However, the coil support apparatus 42 may also comprise the various kinds of support apparatus disclosed in the above-referenced U.S. patent.

Referring now to FIGS. 2–4, a plurality of food products 5 to be vended are placed between the convolutions of each of the coils 22 and 22'. In this regard, when coil 22 is fully loaded, that portion of the coil 22 between the front coil support apparatus 42 and the driven end 26 of the coil 22 will usually sag down into engagement with the shelf surface. As noted previously, coil 22' engages shelf surface 38 over its entire length except at its attachment to motor 36. Thus, the food products contained in the coils 22 or 22' contact and slide along the shelf surface 38 a substantial distance (e.g., at least until they reach the front coil support apparatus 42).

The present invention comprises a detachable insert member generally indicated as 60 which is receivable in the interior of the convolutions of selected coils 22 or 22'. Insert member 60 supports the food products 5 to be vended above the shelf surface 38 as clearly shown in FIG. 4. In this regard, insert member 60 comprises an elongated rail member 62. Rail member 62 may be made of any suitably smooth or semi-smooth material. Preferably, rail member 62 is made of a semi-smooth plastic or other non-metallic material, such as extruded polyvinyl chloride. However, other appropriate materials could also be used. In addition, rail member 62 is sufficiently rigid to adequately support food products 5, but will also flex to some degree under the weight of the products 5. Furthermore, rail member 62 extends from the driven ends 26 and 26' of the coils 22 and 22' preferably over a major portion of the length of coils (i.e., approximately 75–95% of the length). Rail member 62 terminates at a rounded front end portion 64 which is located between the last convolution and the next to last convolution of the coils at the discharge end 24 or 24' of the coils.

As shown in FIGS. 2 snd 3, plastic rail member 62 comprises an upper support surface 66 which is substantially horizontal when rail member 62 is received inside coil 22. Two downwardly tapering surfaces 68 and 70 are integrally formed with support surface 66. The tapering surfaces 68 and 70 connect the upper support surface 66 to a flat bottom surface 72 of rail member 62. Such a cross-sectional configuration is preferred for rail member 62 since it reduces the surface area of rail member 62 which contacts the food products 5. However, other configurations or shapes to the surfaces 66, 68, 70 and 72 are envisioned within the scope of the invention. This prevents or lessens the tendency of the food products 5 to stick or cling to the rail member 62.

In addition, the rear end of rail member 62 has a recess or pocket 74 formed therein. Pocket 74 detachably and firmly receives an L-shaped mounting bracket member 76 or 76'. Bracket members 76 and 76' are substantially identical in construction except as specifically noted hereafter. Therefore, only bracket member 76 will be described in detail with the corresponding portions of bracket 76' being denoted by the same reference numerals as used in bracket 76 with a prime designation added to the numerals. Bracket member 76 has first and second sides or legs 78 and 80 which are disposed at a substantially perpendicular angle relative to one another. The first leg 78 of bracket member 76 is simply slipped into pocket 74 to detachably couple the bracket member 76 to rail member 62. The detachable mounting of bracket members 76 by virtue of pockets 74 is preferred since it allows different sized bracket members 76 to be quickly and easily coupled to one standard sized rail member 62. This reduces the costs of fabricating the insert members 60. However, any appropriate attachment between the bracket member 76 and rail member 62, including a fixed attachment, could be used. The second leg 80 of bracket member 76 has a slotted hole comprising a circular opening 82 with an upwardly extending vertical slot 84.

Each of the electric motors 36 for each of the coils in the dispensing units 20 is provided with a specially elongated shank 34. As shown in FIGS. 2 and 4, shank 34 extends inwardly into the interior of each of the coils a sufficient distance such that the plastic insert member 60 may be coupled thereto. In this regard, elongated shank 34 has an annular groove 86 adjacent its outer end 88. To couple rail member 62 to shank 34, the circular opening 82 is aligned with the end 88 of shank 34 (FIG. 5). Rail member 62 is then moved inwardly relative to the shank 34, with the shank 34 penetrating through the circular opening 82 of the leg 80, until the leg 80 of L-shaped bracket member 76 is aligned with the groove 86. Leg 80 has a thickness which is slightly less than the width of groove 86. Also, the width of the slot 84 is slightly larger than the diameter of groove 86, but less than the diameter of the shank 34. Rail member 62 is then moved downwardly to engage the slot 84 in leg 80 in the groove 86 on the shank 34. Thus, as shown in FIG. 3, insert member 60 is loosely and non-rotatably journaled about the shank 34 of electric motor 36. In other words, even though shank 34 rotates as motor 36 drives coil 22, it will not directly rotate insert member 60. Therefore, the upper support surface 66 of the insert member 60 is operative to support the food products 5 above the shelf surface 38.

As shown in FIG. 3, two different L-shaped bracket members 76 and 76' are used for coupling the insert members 60 to the two differently sized coils. In this regard, the L-shaped bracket members 76 and 76' are generally identical except that the second leg 80 of the bracket 76 is made longer than the second leg 80' of the other bracket 76'. The bracket 76 having the longer leg 80 is used to couple insert member 60 to the shank 34 of the coils 22 with the larger diameter. Similarly, the bracket 76' having the shorter leg 80' couples insert member 60 to the shank of the smaller diameter coils 22'. In any event, regardless of the size of the L-shaped brackets 76 and 76', when the appropriate bracket is used to couple the insert member 60 in an appropriately sized coil, the insert member 60 will ride or contact the lowermost portions of the convolutions of the coil at two transversely spaced discrete points 90 and 92. Thus, rotation of the coil will impart movement to the insert member 60 as described hereafter.

Referring now to FIG. 3, insert members 60 are meant to be detachably coupled in those coils of the vending machine 2 which are dispensing food products 5 that have a tendency to cling or stick to the shelf surface 38. For example, as shown in FIGS. 3 and 4, some food products 5 often comprise relatively heavy pastry products 93, such as donuts 94, which have a saran type of wrapping 96 (i.e., a tough flexible thermoplastic material made by polymerizing and usually copolymerizing vinylidene chloride). This wrapping normally tends to cling or stick to the shelf surface 38 when the food products 5 are allowed to ride in contact with the shelf surface. However, the present invention contemplates using the detachable insert members 60 in each of the coils 22 dispensing such pastry products 93. In these coils then, the pastry products 93 to be vended will no longer contact the shelf surface 38, but will ride on the support surface of the insert member 60. This is a major factor in totally reducing or diminishing the tendency of these products 93 to stick to the shelf surface.

When a purchaser selects a pastry product 93 for purchase, he inserts the required amount of money and activates a control mechanism. This causes the coil to rotate through one revolution to dispense the foremost product 93 contained in the coil 22 off the discharge end of the coil 22 into the discharge space. As the coil rotation occurs, the insert member 60 is substantially free-floating relative to the coil. However, the insert member 60 which contacts the coil at the points 90 and 92 will tend to ride up the side of the coil or be carried along with the coil at least for a short distance as the coil initially begins rotating. See the phantom line representation in FIG. 3. When coil rotation ends, insert member 60 will tend to resume its initial position as shown in solid lines in FIG. 3. This tendency to rock or ride up the side of the coil as the coil begins rotating, and to then fall back down into place at the end of rotation gives a periodic oscillating or rocking action to the insert member 60 for each revolution of coil 22. This rocking action tends to periodically agitate or vibrate the pastry products 93 inside the coil 22. This further lessens the tendency of such products to stick either to the shelf surface 38 or to the insert members 60 themselves. In addition, because the insert member 60 terminates between the last and the next to last convolutions of the coil at the discharge end 24 thereof, the foremost product being vended from the coil 22 will not cling or stick to the end of the insert member 60 as it begins falling into the discharge space.

Although all of the electric motors 36 present in the vending machine 2 are provided with elongated shanks 34, the present invention contemplates using the insert members 60 in the vending machine 2 only for those coils 22 or 22' dispensing food products 5 which require them. Thus, not all the coils 22 and 22' in machine 2 will necessarily have insert member 60 placed in them. However, if desired, insert members 60 could be used inside each of the coils in machine 2 regardless of the type of product being dispensed. In this regard, insert members 60 could be permanently, rather than detachably, coupled to the shanks 34 of motors 36.

In addition to heavy pastry type food products 93 wrapped in the saran wrap type of wrapper, the insert members 60 of the present invention may also be used effectively with food products having a package with a sealed flap at one end. Such food products generally include those customarily used to contain potato chips, corn chips, and the like. When such products rest between the convolutions of the coils 22 or 22' and the shelf surface 38, the package flap at the bottom of the coil is sometimes pushed back as the products are vended forwardly. In some instances, the flap of the packaged product is pinched or caught between the adjacent convolutions on the coils and the shelf surface 38. Thus, when that product reaches the discharge end of the coil where it would normally be vended, it is caught or "hung up" at the discharge end with the flap being pinched between the coil and the shelf surface. In this regard, when an insert member 60 is used inside the coil 22 containing these products, the products no longer ride on the shelf surface 38 but on the support surface 66 of the insert member 60. Thus, there is now no possibility that the flap of the product can work its way back to be pinched underneath the adjacent convolutions of the coil. Thus, the insert members 60 according to the present invention also effectively allow dispensing of this type of food product.

Various modifications will be apparent to those skilled in the art. For example, the insert members 60 of the present invention are not limited for use with vending machine 2 described herein. They may be effectively used with any helical coil or spiral vender type of dispensing machine. All that is required is that the motor means for the coils of the dispensing machine have suitably elongated output shaft shanks for supporting the insert members, or that the vending machines have some other appropriate structure for operatively supporting the insert members in a free-floating manner inside the coils. Furthermore, the coils 22 and 22' could be arranged on the shelves 6 in a side-to-side orientation rather than the front-to-back orientation which has been illustrated in the drawings. In addition, the insert members need not necessarily extend over a major portion of the coil's length when the coil and the products contact the shelf surface only over a relatively small distance. In this situation, the insert members need only extend through the coil over the length of the shelf surface which is actually contacted by the food products. Therefore, the scope of the present invention is to be limited only by the appended claims.

What is claimed is:

1. An improved vending machine of the type having a housing, a plurality of vertically spaced shelves located inside the housing; at least one elongated helical dispensing coil carried on each shelf, each coil having a plurality of convolutions between which a plurality of products to be vended are received, each coil further having a discharge end which is spaced from one wall of the housing to define a discharge space into which each of the products contained in the coil are ejected, and wherein the improvement comprises an elongated insert member which is received inside the convolutions of at least one of the coils, the insert member extending over a sufficient portion of the coil's length and being configured to support those products which would otherwise normally contact the shelf when received between the convolutions of the coil, the insert member being operatively supported in the housing to be free floating relative to the coil, such that rotation of the coil imparts movement to the insert member to prevent the products supported on the insert member from sticking thereto.

2. An improved vending machine as recited in claim 1, in which the insert member is made of substantially smooth plastic.

3. An improved vending machine as recited in claim 2, in which the insert member is made of extruded polyvinyl chloride.

4. An improved vending machine as recited in claim 1, in which the upper surface of the insert member has a first substantially horizontal support surface on which the products are carried, and two downwardly tapering surfaces located on either side of the support surface which do not contact the product, whereby the surface area of the upper surface of the insert member relative to the product is reduced to further lessen the tendency of the products to stick to the insert member.

5. An improved vending machine as recited in claim 1, further having means for selectively rotating each coil about a longitudinal axis thereof, the rotation means further including a rotatable output shaft mounted in coaxial alignment with the coil, and wherein the improvement further comprises the fact that each of the output shafts of each of the rotation means for each of the coils comprises an elongated shank which extends inside the rearmost convolutions of the corresponding coil, and wherein the insert member has a bracket at one end which is loosely and nonrotatably journaled about the shank of the rotation means of the selected coil.

6. An improved vending machine as recited in claim 5, in which the bracket has a slotted hole which engages a groove provided on the shank of the rotation means.

7. An improved vending machine as recited in claim 1, in which the insert member extends over a major portion of the coil's length.

8. An improved vending machine as recited in claim 1, in which the insert member has an outer discharge end which terminates between the last and the next to last convolutions of the coil at the discharge end of the coil, whereby the products being vended by the coil will not stick to the insert.

9. An improved vending machine for dispensing food products, the vending machine being of the type having a housing; a plurality of vertically spaced shelves contained in the housing; each of the shelves having a plurality of dispensing coils mounted thereon, each of the dispensing coils having a plurality of convolutions which respectively receive a plurality of food products to be vended, each of the coils terminating in a discharge end which is spaced from one wall of the housing to define a discharge space into which the food products are vended, at least some of the coils having a first diameter while the remaining coils have a second and smaller diameter; and motor means operatively connected to each of the coils for rotating the coils in a dispensing direction to dispense the products off of the discharge end of the coils; wherein the improvement comprises:

(a) each of the motor means having an output shaft which comprises an elongated shank that terminates inside the rearmost convolutions of each of the dispensing coils; and (b) a plurality of detachable insert members operatively connected to the shanks of selected coils, each of the insert members when connected to the shank extending forwardly in the interior of the convolutions of the coil to support the food products being vended by the coil above the shelf, and the insert members being loosely and nonrotatably journaled on the shanks to be free floating inside the coils to agitate the food products as the coils are rotated, whereby the food products are prevented from sticking to the insert members.

10. An improved vending machine as recited in claim 9, in which each of the insert members comprises an elongated plastic rail member having a rear end adjacent the motor means, the rear end of the rail having a substantially L-shaped bracket member attached thereto, a first leg of the L-shaped bracket member having a hole for loosely journaling the rail member about the shank of the motor means.

11. An improved vending machine as recited in claim 10, in which the rear end of each rail member contains a pocket therein, the L-shaped bracket member having a second leg received inside the pocket to couple the bracket member to the rail member.

12. An improved vending machine as recited in claim 9, wherein the insert members include mounting brackets on one end for coupling the insert members to the shanks of the motor means, the mounting brackets being of two different sizes such that the insert members may be respectively received in the two differently sized coils in such a manner that the insert members ride on the lowermost portions of the convolutions of the coil regardless of the diameter of the coil in which they are received.

13. A dispensing unit for use in dispensing food products or the like from a vending machine, the dispensing unit being suitable for mounting to a shelf in such a machine, which comprises:

(a) an elongated, semi-rigid helical coil having a driven end and a discharge end, the coil having a plurality of convolutions between which a plurality of food products to be vended are received;

(b) motor means for rotating the coil in a dispensing direction, the motor means being operatively connected to the driven end of the coil and having an output shaft which includes an elongated shank that extends through the driven end of the coil and into the interior of the coil coaxially with a longitudinal axis of the coil; and (c) an elongated plastic rail member received inside the convolutions of the coil for supporting the food products contained therein and having opposed first and second ends, the first end of the rail member having a bracket for loosely and nonrotatably journaling the rail member about the shank of the motor means, the rail member extending from the first end to the second end where it terminates between the last and the next to last convolutions of the coil at the discharge end of the coil, whereby the rail member is free floating inside the coil and rides on the lowermost portions of the convolutions of the coil such that rotation of the coil imparts movement to the rail member to agitate the products supported thereby.

14. A dispensing unit for use in dispensing food products or the like from a vending machine, the dispensing unit being suitable for mounting to a shelf in such a machine, which comprises:

(a) an elongated, semi-rigid helical coil having a driven end and a discharge end, the coil having a plurality of convolutions between which a plurality of food products to be vended are received;

(b) motor means for rotating the coil in a dispensing direction, the motor means being operatively connected to the driven end of the coil; and (c) an elongated rail member received inside the convolutions of the coil beneath the food products contained therein and having opposed first and second ends, the first end of the rail member having means for loosely journaling the rail member on a portion of the motor means and the rail member otherwise being unattached to the motor means, the coil and the vending machine such that the rail member is free floating inside the coil, and wherein the rail member is configured to ride on the lower most portions of the convolutions of the coil such that rotation of the coil imparts movement to the rail member to agitate the products located on top of the rail member.

* * * * *